US005612663A

United States Patent [19]

Hollweck

[11] Patent Number: 5,612,663

[45] Date of Patent: Mar. 18, 1997

[54] DUAL-TEMPERATURE FUSE

[75] Inventor: Walter Hollweck, Heroldsberg, Germany

[73] Assignee: Inter Control Hermann Kohler Elektrik Gmbh & Co. KG, Nuremberg, Germany

[21] Appl. No.: 405,974

[22] Filed: Mar. 17, 1995

[30] Foreign Application Priority Data

Mar. 18, 1994 [DE] Germany ..... 44 09 243.1
Jul. 14, 1994 [DE] Germany ..... 44 24 821.0

[51] Int. Cl.[6] ..... H01H 37/76

[52] U.S. Cl. ..... 337/407; 337/150; 337/408

[58] Field of Search ..... 337/161, 148, 337/186, 219, 298, 315, 317, 318, 325, 401–412; 361/103, 104; 439/816, 830

[56] References Cited

U.S. PATENT DOCUMENTS 3,412,356 3/1967 Van Horssen ..... 337/150

4,189,697 2/1980 Hara ..... 337/407

*Primary Examiner*—Leo P. Picard
*Assistant Examiner*—Jayprakash N. Gandhi
*Attorney, Agent, or Firm*—Robin, Blecker, Daley & Driscoll

[57] ABSTRACT

A thermal fuse which interrupts at least one current path which runs through it when a triggering temperature value is exceeded, with a fuse housing in which at least two thermal fuse elements are arranged and from which at least two connection contacts project for forming at least one current path, where a closed contact segment is bridged in the interior of the housing, via a movement contact when the fuse has not responded, and a fuse element puts spring stress on the movement contact assigned to it, in the contact closing direction, which contact interrupts at least one current path when triggered, characterized in that the fuse housing is formed in a pipe shape and has two holder chambers for insertion of the thermal fuse elements, which are separated from one another by a partition floor which essentially closes off the cross-section of the pipe and that the thermally sensitive elements of at least two thermal fuse elements impact the partition floor.

18 Claims, 3 Drawing Sheets

DUAL-TEMPERATURE FUSE

FIELD OF THE INVENTION

The invention relates generally to fuses and pertains more particularly to a thermal fuse which interrupts at least one current path which runs through it when a triggering temperature value is exceeded.

BACKGROUND OF THE INVENTION

Thermal fuses with a multiplicity of thermal fusing and/or switching elements are known as combination devices. For example, such devices have a fuse housing in which a multiplicity of thermal fusing and/or switching elements is arranged, which can form a limiter/regulator combination. In order to be able to connect such thermal fuses, at least two connection contacts project out of their fuse housing, which are connected with a contact segment which can be bridged by a movement contact in the interior of the housing. One of the fuse elements puts stress on the movement contact in the contact closing direction with spring tension; the movement contact interrupts the current path when the fuse responds.

Furthermore, single fuses are known which have a pipe-like housing, in which a thermally sensitive element in the form of a fusing material cartridge is arranged, which brings about an interruption of the current path which runs through the fuse when a temperature value defined by the fusing material is exceeded.

For safety reasons, it is considered practical to use such fuses containing a fusing material in serial circuits, where the two single fuses which are switched in series should either respond to different temperature values, or at least should be manufactured on different production machines. In case the temperature is exceeded, this ensures that at least one of the two fuses will respond and will bring about the shut-off required for safety reasons.

SUMMARY OF THE INVENTION

The present invention has as its primary object the provision of developing a thermal fuse which satisfies a high level of safety requirements. An additional object of the invention is to provide a thermal fuse which is easy to manufacture and particularly is easy to install.

In attaining these and other objects, the invention provides for a thermal fuse as recited in claim 1, characterized in that at least the fuse housing is formed in a pipe shape and has two holder chambers for insertion of the thermal fuse elements which are separated from one another by a partition floor which essentially closes off the cross-section of the pipe and that the thermally sensitive elements of at least two thermal fuse elements impact the partition floor.

The foregoing and other objects and features of the invention will be further understood from the following detailed description of preferred embodiments thereof and from the drawings, wherein like reference numerals identify like parts throughout.

DETAILED DESCRIPTION OF PREFERRED EMBODIMENTS AND PRACTICES

Figure 1:
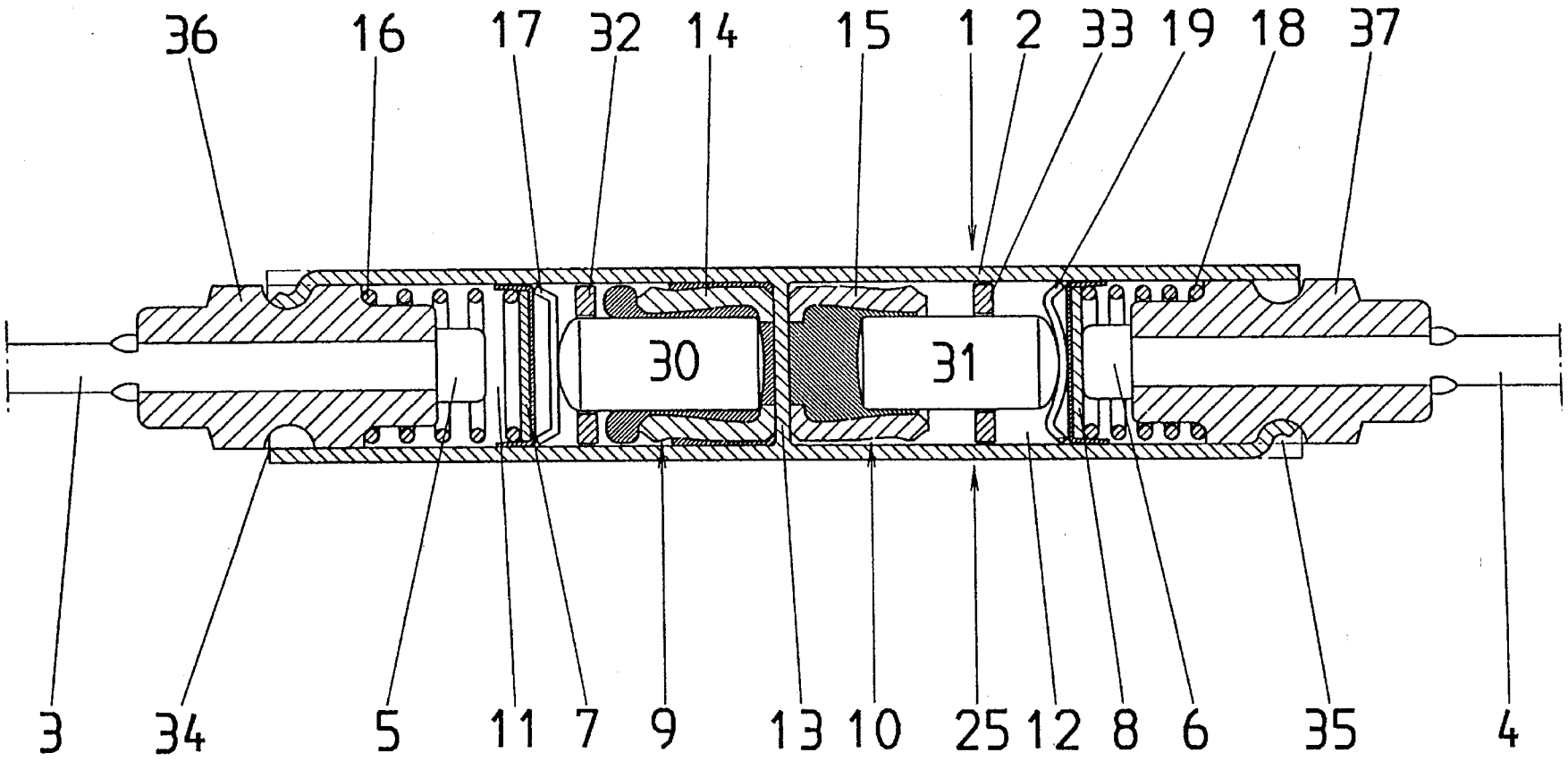
FIG. 1 is a cross-sectional view through a thermal fuse with two fuse elements held by spring action by means of a star with a pot-like embossing, with one of the two fuse elements having responded.

Referring to FIG. 1, a thermal fuse 1 has a current path which runs through its fuse housing 2, which comprises two connection contacts 3, 4, at which fixed contacts 5, 6 are arranged, which interact with movement contacts 7, 8, which latter contact the metallic fuse housing, so that the current path as a whole consists of the elements 3, 5, 7, 2, 8, 6, 4 (in that order from left to right) through the fuse housing 2.

In all, two thermal fuse elements 9, 10 are provided in the fuse housing 2, which are arranged in two holder chambers 11, 12 of the fuse housing 2, which has an overall pipe-like structure. The two holder chambers 11, 12 are separated from one another by means of a partition floor 13 which essentially closes off the pipe cross-section, the thermally sensitive elements, namely sleeves 14, 15 which contain fusing solder, impact the partition floor 13 with their interior ends under the force of springs 16, 17, 18, 19, where the springs 16 and 18 are structured as contact opening springs which lift the movement contact 7, 8 from the fixed contact 5, 6 as soon as the related fuse element 9 or 10 responds, and the springs 17 and 19 are structured as so-called "star springs" which ensure the necessary contact closing pressure between the movement contact and the fixed contact when the fuse element 9, 10 has not responded, as is shown on the right side of FIG. 1, since the fuse element 10 shown there has not responded yet. The fuse element 9 on the left side, on the other hand, has been triggered, which has caused the contact segment between the fixed contact 5 and the movement contact 7 to open.

Figure 2:
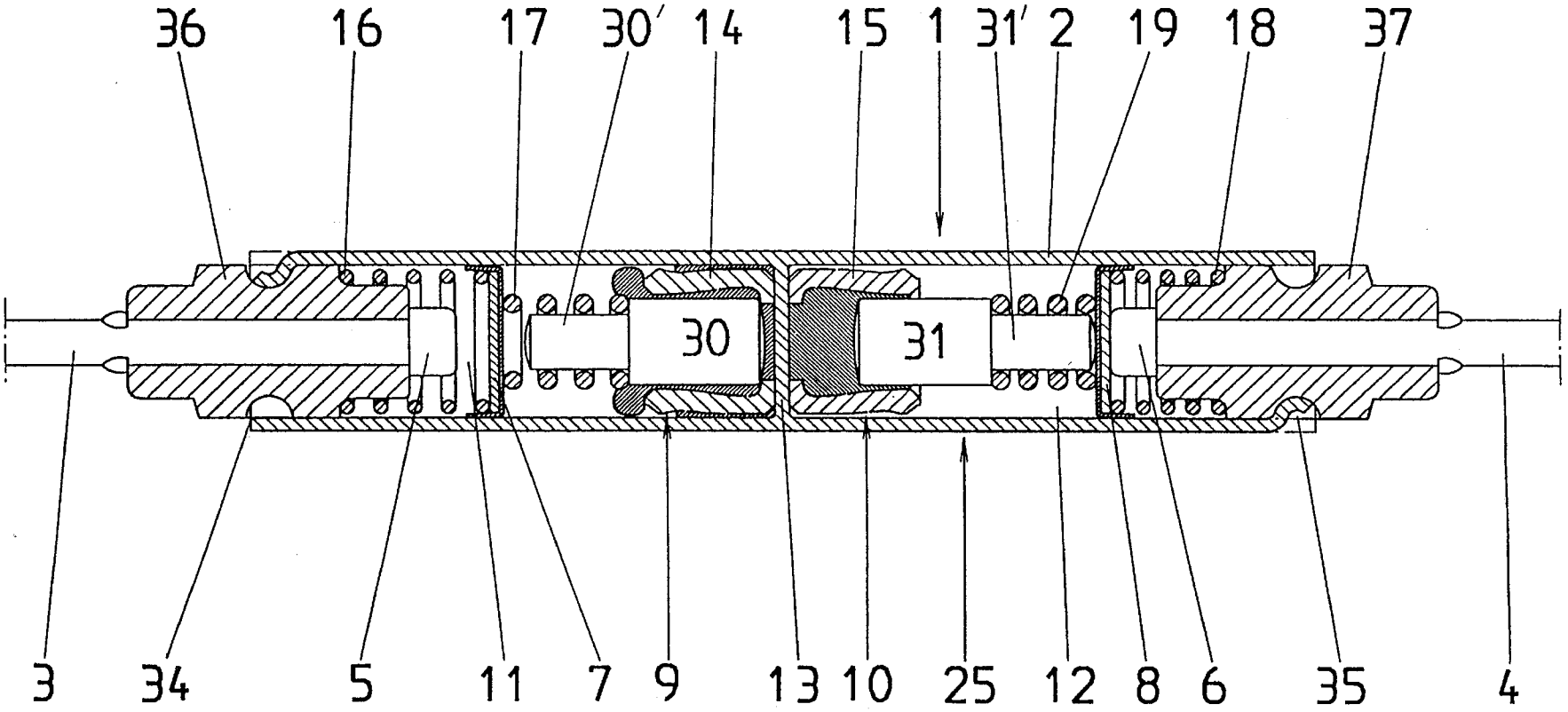
FIG. 2 is a cross-sectional view through a thermal fuse with two fuse elements held by spring action by means of a spiral spring, with one of the two fuse elements having responded.

As is evident from FIG. 2, the springs 17 and 19 can also be structured as spiral springs which take over the same function as the "star springs" according to FIG. 1. For this purpose, it is advantageous to form the transfer pins 30 and 31 with a set-back region 30' and 31', which extends into the interior region of the springs 17 and 19, which are now formed as spiral springs, and thus provides position stabilization of the spiral springs.

Figure 3:
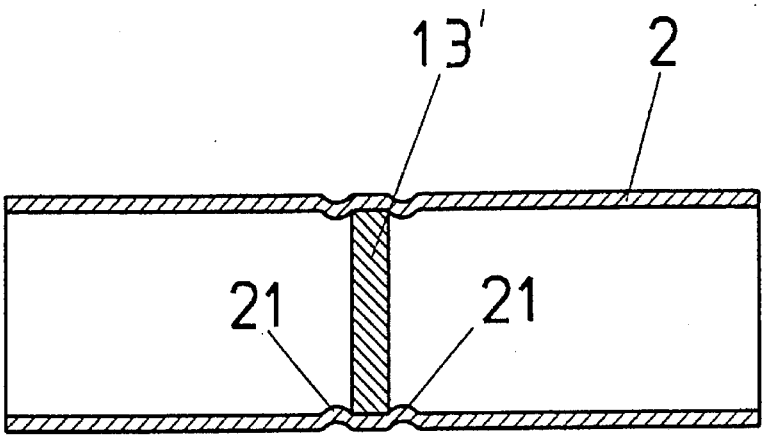
FIG. 3 is a partial cross-sectional view through the region of the fuse housing which contains the partition floor.
Figure 4:
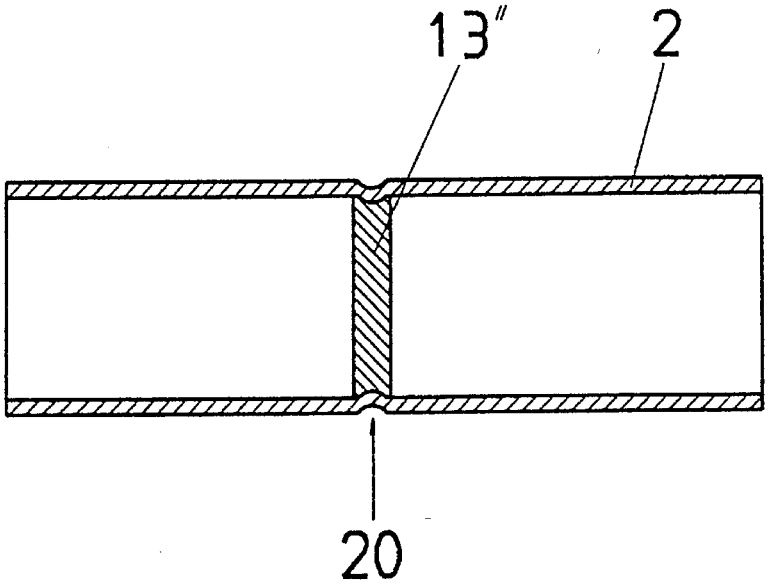
FIG. 4 is a partial cross-sectional view through the region of the fuse housing which has a modified partition floor.

The two holder chambers 11, 12 run coaxial to one another in the fuse housing 2 which is structured as a straight pipe piece. In the embodiments shown in FIGS. 1 and 2, the partition floor 13 is formed in one piece with the fuse housing. FIGS. 3 and 4, however, show other embodiment possibilities in which the partition floor 13' can be a separate disk, the diameter of which essentially corresponds to the inside diameter of the pipe-shaped fuse housing 2. As is particularly evident in FIG. 4, the partition floor 13" can have a circumferential groove, into which an embossing 20 of the fuse housing which is directed radially towards the inside engages. In the embodiment shown in FIG. 3, the partition floor 13' lies between two embossings 21 of the pipe-shaped fuse housing which are directed radially towards the inside.

Figure 5:
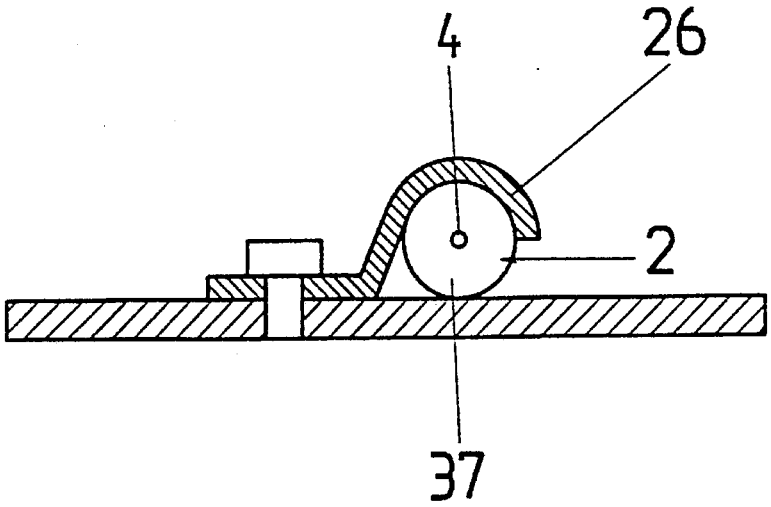
FIG. 5 is a schematic cross-sectional view through a fuse attached to an equipment wall to be monitored by means of an attachment element.

The outside housing wall 25 of the fuse housing 2 is structured as a heat transfer surface in the region of the partition floor 13, 13', 13", and works together with at least one holder element 26, which puts pressure directed radially inward on the fuse housing, in the region of the partition wall (see FIG. 5).

With reference to FIGS. 1 and 2, each sleeve 14, 15 is provided with a transfer pin 30, 31, which dips into the fusing material when the thermally sensitive element responds and the fusing material becomes liquid, under the pressure of the related opening spring 16, 18, and is guided in a disk-like guide element 32, 33 on the outside of the sleeve.

The two outside ends 34, 35 of the pipe-shaped fuse housing are provided with end closures 36, 37, which consist of insulating material and contain the connection contacts 3, 4 in each instance, at the inside ends of which the fixed contacts 5, 6 are arranged.

By way of summary, the invention will be seen to provide for a thermal fuse as recited in claim 1, characterized in that at least the fuse housing is formed in a pipe-like manner which is provided with two holder chambers for the insertion of the thermal fuse elements, where the holder chambers can be essentially identical in form. Between the two fuse chambers, a partition floor is provided, which essentially closes off the interior cross-section of the pipe, and against which the thermally sensitive fuse elements rest on both sides, under spring pressure. This advantageously achieves the result that the heat introduction to the thermally sensitive elements via the housing takes place via one and the same element, namely the partition floor, with good heat conductivity. This causes the fuse to demonstrate well-defined response behavior. Furthermore, the partition floor forms a mechanical stabilization of the otherwise pressure-sensitive pipe-shaped housing, which ensures that if the housing is installed using a clamping element in the center region, which impacts the housing with pressure directed radially inward, moving parts are not clamped in place, so that the fuse can continue to function.

The fuse of the present invention is also easy to manufacture and to adjust. The housing can be cut from a pipe segment and the partition floor can be introduced and pressed into place. Then the prepared fuse elements can be inserted and fitted with connection elements and pressed to form a block. At the same time, this ensures that the thermally sensitive parts rest against the partition floor, which serves as the heat conduction element with good heat contact.

If the two holder chambers run coaxial to one another, a straight piece of pipe can be used as the housing, and the pressing process for pressing the elements of the fuse into place, in particular, can be performed in a single pressing stroke. The partition floor can either be formed in one piece with the pipe-shaped housing, or can be a separate disk which can be attached in different ways.

It is particularly advantageous for heat introduction into the housing to form the outside wall of the housing as a heat transfer surface in the region of the partition floor, which surface can be clamped onto a component to be monitored. An external holder element which impacts the housing with pressure directed radially inward in the region of the partition wall is suitable for this. Since the housing is stabilized against pressure by the partition floor, the heat transfer surface can be pressed very tightly against the component to be monitored.

With respect to each sleeve being provided with a transfer pin, which dips into the fusing material when the thermally sensitive element responds and the fusing material becomes liquid under the pressure of an opening spring and is held in place in a disk-like guide element on the outside of the sleeve, and particularly, with respect to the disk-like guide element which surrounds the transfer pin of the fusing sleeves outside of the sleeves, it is possible to advantageously undertake a further division of the holder chambers into an inside region and an outside region. The sleeve containing the fusing material is arranged in the inside region, the springs and the contacts are provided in the outside region of the two chambers. In case of a response, the fusing solder is held in the inside chamber region by means of the guide disk, which prevents incorrect contacts in the region of the movement contact when the fuse has responded.

Various changes in practice and modifications in structure may evidently be introduced in the foregoing particularly disclosed and described embodiments and practices without departing from the invention. Thus, such embodiments and practices are intended in an illustrative and not in a limiting sense. The true spirit and scope of the invention is set forth in the ensuing claims.

What is claimed is:

1. A thermal fuse which interrupts at least one current path running through it when a triggering temperature value is exceeded, with a fuse housing in which at least two thermal fuse elements are arranged and from which at least two connection contacts project for forming the at least one current path, where a closed contact segment is bridged in the interior of the housing, via a movement contact, when the fuse has not responded, and a fuse element puts spring stress on the movement contact assigned to it in the contact closing direction, which contact interrupts at least one current path when triggered, including the fuse housing being formed in a pipe shape and having two holder chambers for insertion of the thermal fuse elements which are separated from one another by a partition floor which essentially closes off the cross-section of the pipe and that the thermally sensitive elements of the at least two thermal fuse elements impact the partition floor, the two holder chambers running coaxial to one another, and the partition floor being formed in one piece with the pipe-shaped fuse housing.

2. The invention claimed in claim 1, wherein the pipe-shaped fuse housing comprises a metallic, electrically conductive material, and is impacted by contact elements which interact with the movement contact of the two thermal fuse elements on the inside of the pipe.

3. The invention claimed in claim 2, wherein the thermally sensitive elements are formed by a fusing material, particularly sleeves containing fusing solder, which impact the partition floor on both sides.

4. The invention claimed in claim 3, wherein the partition floor consists of material with good thermal conductivity.

5. The invention claimed in claim 4, wherein the outside wall of the housing is formed as a heat transfer surface in the region of the partition floor.

6. The invention claimed in claim 5, wherein at least one holder element is provided, which impacts the fuse housing with pressure directed radially towards the inside in the region of the partition floor.

7. The invention claimed in claim 6, wherein the two outside ends of the pipe-shaped fuse housing are provided with end closures, which consist of insulating material and contain at least one connection contact, at the inside end of which the fixed contact of the fuse element is arranged.

8. The invention claimed in claim 7, wherein each sleeve is provided with a transfer pin, which dips into the fusing material when the thermally sensitive element responds and the fusing material becomes liquid, under the pressure of an opening spring, and is held in place in a disk-like guide element on the outside of the sleeve.

9. The invention claimed in claim 8, wherein the spring which acts between the movement contact and the transfer pin is formed by a spiral spring, which impacts the transfer pin in the direction of the partition floor with its one end, and which rests against the surface of the movement contact which faces towards the partition floor with its other end.

10. The invention claimed in claim 9, wherein the spring surrounds the transfer pin.

11. The invention claimed in claim 10, wherein the transfer pin has a set-back region with a reduced diameter, which projects into the interior region of the spring.

12. The invention claimed in claim 8, wherein the spring which acts between the movement contact and the transfer pin is formed by a star embossed in pot-like manner, which impacts the transfer pin in the direction of the partition floor with its interior region, and which rests against the surface of the movement contact which faces towards the partition floor with its outside region.

13. A thermal fuse which interrupts at least one current path running through it when a triggering temperature value is exceeded, with a fuse housing in which at least two thermal fuse elements are arranged and from which at least two connection contacts project for forming the at least one current path, where a closed contact segment is bridged in the interior of the housing, via a movement contact, when the fuse has not responded, and a fuse element puts spring stress on the movement contact assigned to it in the contact closing direction, which contact interrupts at least one current path when triggered, including the fuse housing being formed in a pipe shape and having two holder chambers for insertion of the thermal fuse elements which are separated from one another by a partition floor which essentially closes off the cross-section of the pipe and that the thermally sensitive elements of the at least two thermal fuse elements impact the partition floor, the two holder chambers running coaxial to one another and the partition floor being a separate disk, the diameter of the disk essentially corresponding to the inside diameter of the pipe-shaped fuse housing.

14. The invention claimed in claim 13, wherein the partition floor has a circumferential groove into which an embossing of the pipe-shaped fuse housing, directed radially towards the inside, engages.

15. The invention claimed in claim 14, wherein the partition floor is arranged between two embossings of the pipe-shaped fuse housing, directed radially towards the inside.

16. A thermal fuse which interrupts at least one current path running through it when a triggering temperature value is exceeded, with a fuse housing in which at least two thermal fuse elements are arranged and from which at least two connection contacts project for forming the at least one current path, where a closed contact segment is bridged in the interior of the housing, via a movement contact, when the fuse has not responded, and a fuse element puts spring stress on the movement contact assigned to it in the contact closing direction, which contact interrupts at least one current path when triggered, including the fuse housing being formed in a pipe shape and having two holder chambers for insertion of the thermal fuse elements which are separated from one another by a partition floor which essentially closes off the cross-section of the pipe and that the thermally sensitive elements of the at least two thermal fuse elements impact the partition floor, the partition floor being formed in one piece with the pipe-shaped fuse housing.

17. A thermal fuse which interrupts at least one current path running through it when a triggering temperature value is exceeded, with a fuse housing in which at least two thermal fuse elements are arranged and from which at least two connection contacts project for forming the at least one current path, where a closed contact segment is bridged in the interior of the housing, via a movement contact, when the fuse has not responded, and a fuse element puts spring stress on the movement contact assigned to it in the contact closing direction, which contact interrupts at least one current path when triggered, including the fuse housing being formed in a pipe shape and having two holder chambers for insertion of the thermal fuse elements which are separated from one another by a partition floor which essentially closes off the cross-section of the pipe and that the thermally sensitive elements of the at least two thermal fuse elements impact the partition floor, the partition floor being a separate disk, the diameter of the disk essentially corresponding to the inside diameter of the pipe-shaped fuse housing.

18. The invention claimed in claim 17, wherein the partition floor has a circumferential groove into which an embossing of the pipe-shaped fuse housing, directed radially towards the inside, engages.

* * * * *